US011446210B2

(12) United States Patent
Dyk

(10) Patent No.: US 11,446,210 B2
(45) Date of Patent: Sep. 20, 2022

(54) ORAL SYRINGE WITH INCLINED GUARD

(71) Applicant: BABYHAPPY LTD., Weybridge (GB)

(72) Inventor: Dorota Dyk, Weybridge (GB)

(73) Assignee: BABYHAPPY LTD., Weybridge Surry (GB)

( * ) Notice: Subject to any disclaimer, the term of this patent is extended or adjusted under 35 U.S.C. 154(b) by 0 days.

(21) Appl. No.: 15/036,194

(22) PCT Filed: Nov. 17, 2014

(86) PCT No.: PCT/EP2014/074815

§ 371 (c)(1),
(2) Date: May 12, 2016

(87) PCT Pub. No.: WO2015/071476

PCT Pub. Date: May 21, 2015

(65) Prior Publication Data

US 2016/0279031 A1 Sep. 29, 2016

(30) Foreign Application Priority Data

Nov. 15, 2013 (GB) ..... 1320255

(51) Int. Cl.
*A61J 7/00* (2006.01)

(52) U.S. Cl.
CPC ..... *A61J 7/0053* (2013.01)

(58) Field of Classification Search
CPC ..... A61J 7/0053; A61J 7/00; A61J 7/0046; A61J 17/001; A61J 11/0005; A61J 11/004;

(Continued)

(56) References Cited

U.S. PATENT DOCUMENTS 3,572,337 A * 3/1971 Schunk ..... A61J 7/0053 604/77
4,127,126 A 11/1978 Schunk (Continued)

FOREIGN PATENT DOCUMENTS

CN 87209795 U 7/1988
CN 2049529 U 12/1989

(Continued)

OTHER PUBLICATIONS

Theisen Dental Supply; http://www.thetheisendentaldupply.com/ALGISYR-ALY001-_p_230.html, retrieved from the Internet Jun. 1, 2016, 2 pages.

(Continued)

*Primary Examiner* — Bradley J Osinski
(74) *Attorney, Agent, or Firm* — Fay Sharpe LLP

(57) ABSTRACT

An oral dispensing device includes a main body for holding liquid and a guard, the main body being straight, elongated and having a longitudinal axis, and capable of dispensing the held liquid from one end. The guard is set upon the main body with a front portion of the main body protruding from the front of the guard. The guard is shaped such that when the front portion is placed in a mouth of a subject, the guard lies against the front of a face of the subject, such that if the front of the face of the subject is considered as a plane, the longitudinal axis of the liquid holding body is inclined to the plane of the face.

17 Claims, 7 Drawing Sheets

(58) Field of Classification Search
CPC ..... A61M 16/0488; A61M 16/049; A61M 16/0493; A61M 2210/0625–0656
See application file for complete search history.

(56) References Cited

U.S. PATENT DOCUMENTS

| | | | | |
|---|---|---|---|---|
| 4,240,425 | A | 12/1980 | Akhavi | |
| 4,315,743 | A | 2/1982 | Brugirard | |
| 4,688,571 | A | 8/1987 | Tesler | |
| 4,915,242 | A | 4/1990 | Marte | |
| 5,083,921 | A | 1/1992 | Dragan | |
| 5,123,915 | A | 6/1992 | Miller et al. | |
| 5,176,705 | A * | 1/1993 | Noble | A61J 17/001 604/77 |
| D335,187 | S | 4/1993 | Stege | |
| 5,242,422 | A | 9/1993 | Schneberger et al. | |
| 5,244,122 | A * | 9/1993 | Botts | A61J 7/0046 222/158 |
| 5,300,024 | A | 4/1994 | Yang | |
| 5,318,523 | A | 6/1994 | Lu | |
| 5,431,680 | A * | 7/1995 | Jones | A61J 7/0053 604/210 |
| 5,512,047 | A | 4/1996 | Dvorak | |
| 5,514,142 | A | 5/1996 | Dean-Homolka | |
| 5,522,848 | A | 6/1996 | Kamali | |
| 5,542,922 | A | 8/1996 | Petterson et al. | |
| 5,557,905 | A | 9/1996 | Harding | |
| D377,830 | S | 2/1997 | Lai | |
| 5,649,713 | A | 7/1997 | Ledgerwood | |
| 5,662,684 | A | 9/1997 | Caso | |
| D397,216 | S | 8/1998 | Armand | |
| 5,807,156 | A | 9/1998 | Owen | |
| 5,810,886 | A | 9/1998 | Hassan | |
| 5,843,030 | A * | 12/1998 | Van Der Merwe | A61J 7/0053 604/77 |
| 5,891,165 | A | 4/1999 | Buckner | |
| 6,110,193 | A | 8/2000 | Chen | |
| 6,126,679 | A | 10/2000 | Botts | |
| 6,139,566 | A | 10/2000 | Bennett | |
| 6,190,364 | B1 | 2/2001 | Imbert | |
| D448,844 | S | 10/2001 | Reis | |
| 6,454,788 | B1 | 9/2002 | Ashton | |
| 6,511,455 | B1 | 1/2003 | Tuoriniemi | |
| D476,085 | S | 6/2003 | Dumont et al. | |
| 6,684,918 | B1 | 2/2004 | Thilly et al. | |
| D492,417 | S | 6/2004 | Davis | |
| 6,808,161 | B1 | 10/2004 | Hishikawa | |
| 7,125,394 | B2 | 10/2006 | Berman et al. | |
| D542,406 | S | 5/2007 | Knight et al. | |
| 7,252,676 | B1 | 8/2007 | Williams | |
| 8,016,795 | B2 | 9/2011 | Barrelle et al. | |
| 8,056,508 | B1 | 11/2011 | Bryan et al. | |
| 8,062,254 | B2 | 11/2011 | MacLean | |
| 8,118,773 | B2 | 2/2012 | Stewart | |
| D671,652 | S | 11/2012 | Middleton | |
| 8,985,357 | B1 * | 3/2015 | Strayer | A61J 11/0005 215/11.1 |
| 9,974,714 | B1 * | 5/2018 | Middleton | A61J 7/0053 |
| 2002/0129816 | A1 | 9/2002 | Williams et al. | |
| 2003/0034031 | A1 | 2/2003 | Lev et al. | |
| 2003/0141268 | A1 | 7/2003 | Kerns et al. | |
| 2004/0211484 | A1 | 10/2004 | Fournie et al. | |
| 2004/0230017 | A1 | 11/2004 | Kerns et al. | |
| 2005/0165351 | A1 | 7/2005 | Tamagni, Jr. | |
| 2007/0027479 | A1 * | 2/2007 | Carter | A61J 7/0053 606/234 |
| 2007/0262178 | A1 | 11/2007 | Fischer et al. | |
| 2008/0177305 | A1 | 7/2008 | Vath et al. | |
| 2010/0280492 | A1 * | 11/2010 | Krumins | A61J 7/0053 222/23 |
| 2011/0224648 | A1 | 9/2011 | Secci | |
| 2011/0253251 | A1 | 10/2011 | Mudd | |
| 2011/0295197 | A1 | 12/2011 | Hazan | |
| 2013/0085456 | A1 | 4/2013 | Berman et al. | |
| 2013/0090595 | A1 | 4/2013 | Brenner | |
| 2014/0051926 | A1 * | 2/2014 | Oates, II | A61J 7/0053 600/109 |

FOREIGN PATENT DOCUMENTS

| | | | |
|---|---|---|---|
| CN | 2120577 | U | 11/1992 |
| CN | 2120579 | | 11/1992 |
| CN | 2128137 | Y | 3/1993 |
| CN | 2146991 | Y | 11/1993 |
| CN | 2180252 | Y | 10/1994 |
| CN | 2149203 | | 12/1994 |
| CN | 2274960 | Y | 2/1998 |
| CN | 2305996 | Y | 2/1999 |
| CN | 2335630 | Y | 9/1999 |
| CN | 2351130 | Y | 12/1999 |
| CN | 2381320 | Y | 6/2000 |
| CN | 2633285 | Y | 8/2004 |
| CN | 1528259 | A | 9/2004 |
| CN | 2770667 | | 4/2006 |
| CN | 2812925 | Y | 9/2006 |
| CN | 2873199 | Y | 2/2007 |
| CN | 2929244 | Y | 7/2007 |
| CN | 201079566 | Y | 7/2008 |
| CN | 201290931 | Y | 8/2009 |
| CN | 201394210 | Y | 2/2010 |
| CN | 201492692 | U | 6/2010 |
| CN | 201603120 | U | 10/2010 |
| CN | 202061102 | U | 12/2011 |
| CN | 202844251 | | 4/2013 |
| DE | 299 12 596 | U1 | 11/1999 |
| DE | 198 58 455 | A1 | 6/2000 |
| DE | 10 2011 107 942 | | 11/2014 |
| FR | 2 594 328 | | 8/1987 |
| FR | 2 773 695 | | 7/1999 |
| FR | 2 775 896 | A1 | 9/1999 |
| FR | 2 927 517 | A1 | 8/2009 |
| FR | 2 928 538 | | 9/2009 |
| FR | 2 930 428 | | 10/2009 |
| GB | 2 024 974 | A | 1/1980 |
| GB | 2 082 091 | A | 3/1982 |
| GB | 2 089 332 | A | 6/1982 |
| GB | 2 093 705 | A | 9/1982 |
| GB | 2 252 766 | A | 8/1992 |
| GB | 2 271 287 | A | 4/1994 |
| GB | 2 307 681 | A | 6/1997 |
| GB | 2 309 966 | A | 8/1997 |
| GB | 2 407 273 | A | 4/2005 |
| JP | 2001-510075 | | 7/2001 |
| JP | 2009-78023 | | 4/2009 |
| JP | 2009-178530 | | 8/2009 |
| JP | 2010-531153 | | 9/2010 |
| WO | WO 92/06651 | | 4/1992 |
| WO | WO 97/28777 | | 8/1997 |
| WO | WO 98/44892 | | 10/1998 |
| WO | WO 02/085429 | A2 | 10/2002 |
| WO | WO 02/099356 | A2 | 12/2002 |
| WO | WO 03/029748 | A1 | 4/2003 |
| WO | WO 03/076868 | A1 | 9/2003 |
| WO | WO 2003/083406 | A1 | 10/2003 |
| WO | WO 2005/006689 | A1 | 1/2005 |
| WO | WO 2005/052499 | A1 | 6/2005 |
| WO | WO 2005/060173 | A1 | 6/2005 |
| WO | WO 2005/117745 | A1 | 12/2005 |
| WO | WO 2010/105309 | A1 | 9/2010 |
| WO | WO 2011/027366 | A1 | 3/2011 |
| WO | WO 2011/057366 | A1 | 5/2011 |
| WO | WO 2012/131138 | A1 | 10/2012 |

OTHER PUBLICATIONS

Independent Living Centre NSW; https://ilcnsw.asn.au/items/321, Ezy Dose Orasyringe, retrieved from the Internet Jun. 1, 2016, 3 pages.

https://www.amazon.com/ Monoject-412-Syringe-Plastic-Curved/dp/B001EMEXNI?ie=UTF8&*Version*=1&*entries*=0, retrieved from the Internet Jun. 1, 2016, 5 pages.

(56) References Cited

OTHER PUBLICATIONS

International Search Report, PCT/EP2014/074815, dated Mar. 11, 2015, Completed Mar. 4, 2015, 3 pgs.
Written Opinion of the Int'l Searching Authority, PCT/EP2014/074815, dated Mar. 11, 2015, Completed Mar. 4, 2015, 5 pgs.

* cited by examiner

ORAL SYRINGE WITH INCLINED GUARD

CROSS-REFERENCE TO RELATED APPLICATIONS

This application is a National Stage Entry of PCT/EP2014/074815, and claims priority to, and the benefit of, Great Britain Patent Application No. GB 1320255.1, filed Nov. 15, 2013, the entirety of which is hereby incorporated by reference as if fully set forth herein.

The present specification relates to oral syringes, particularly but not exclusively for babies and infants.

Oral medicine is often administered to babies and infants by means of syringe. After an appropriate amount of medicine has been drawn into the syringe, the end of the syringe is inserted in the mouth of the infant, and the syringe plunger is depressed, so that the medicine is expelled into the infant's mouth. A jet of liquid directed into the throat can cause an infant to choke or gag. Therefore, it is usually recommended that the syringe is not aimed directly towards the throat, but towards the cheek. The infant can then swallow the medicine using the normal swallowing reflex.

Inexperienced carers may though be ignorant or unsure of the ideal oral dosing method.

An object of the present invention is to encourage or ensure that those administering medicine orally do so in way that is comfortable and safe for babies or other users. A further object is that the administration of oral medicine is quick and convenient.

According to the present invention, there is provided an oral syringe device according to claim 1.

The invention will now be described, by way of example, with reference to the drawings, of which FIG. 1 is a perspective view of the syringe adapter and syringe;

Figure 1:
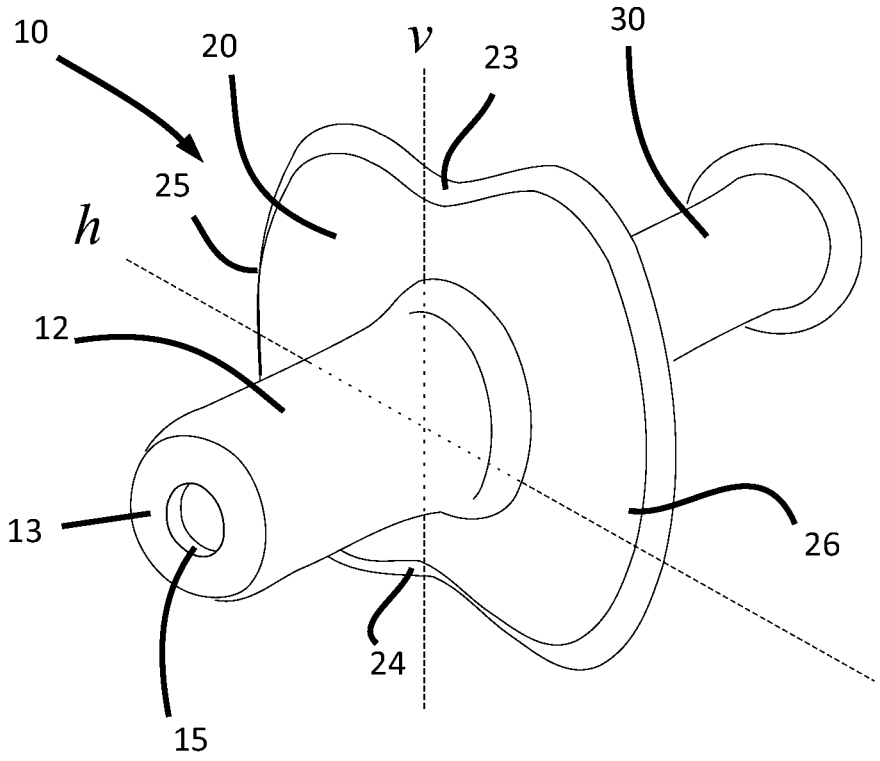
Figure 2:
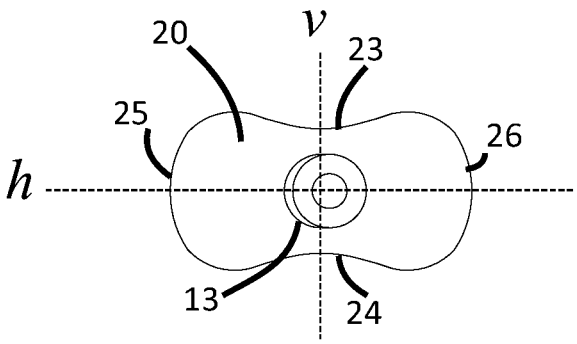
FIG. 2 is a front elevation of the syringe adapter.
Figure 3:
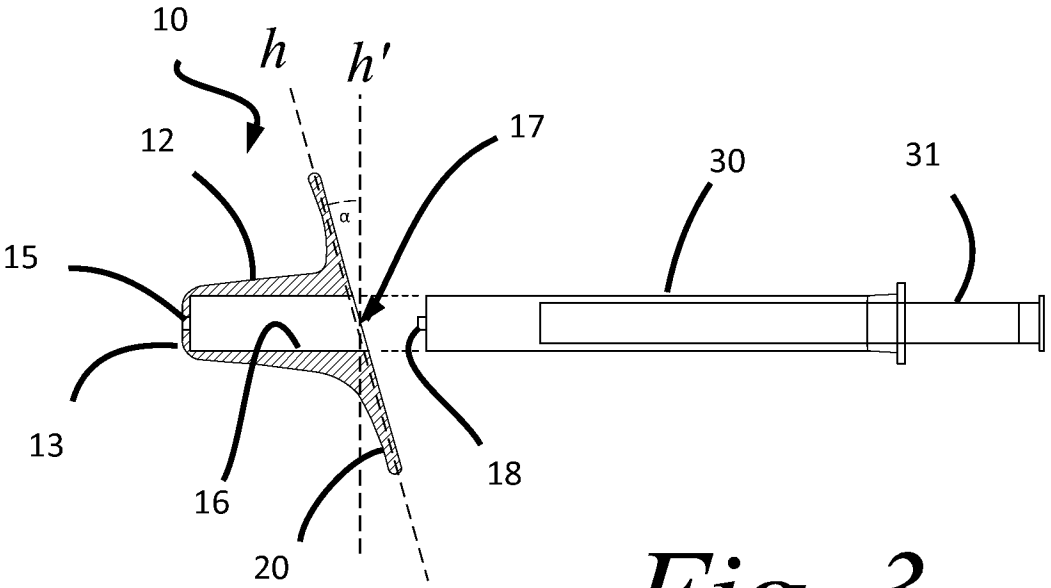
FIG. 3 is an exploded longitudinal section of the syringe adapter and syringe.
Figure 4:
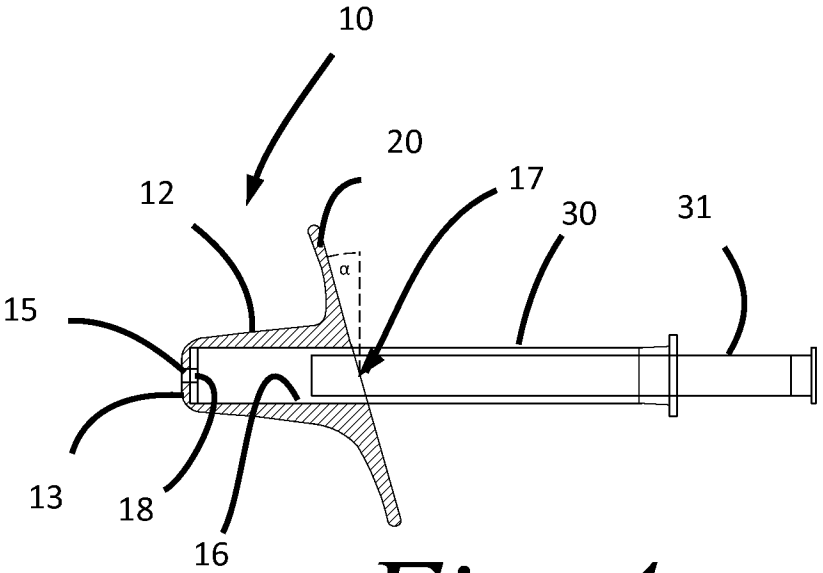
FIG. 4 is a longitudinal section of the syringe adapter and syringe.

Referring to FIGS. 1, 2 and 3, a syringe adapter 10 comprises a shaft 12, and a guard 20. The syringe adapter includes a cylindrical cavity 16, having an opening 17, so that a conventional oral syringe 30 may be inserted through the opening into the cavity, as shown in FIG. 4.

The syringe adapter is formed from a flexible, resilient material, such as silicone, or natural rubber. The shape and dimensions of the cavity 16 may be chosen to be slightly smaller than the syringe 30, so that the cavity expands when the syringe is introduced, and the syringe adapter grips the syringe, so that it remains on the syringe until the user separates the syringe and syringe adapter.

The shaft 12 of the syringe adapter is cylindrical, terminating in an annular end 13, which features an aperture 15. The size and shape of the aperture 15 is chosen to correspond to the nozzle or aperture of an oral syringe. Similarly, the cavity of the syringe adapter is generally shaped to correspond to the shape of the syringe. The end of the syringe adapter 13 could be flat, but also could for example be angled or chamfered. Also, the dispensing end of the syringe may or may not be flat.

The guard 20 is located at the base of the shaft 12, opposite the annular end 13. The guard is generally planar and has a shape formed of two convex sides 25, 26 separated by two concave upper and lower edges. The shape has two axes of symmetry, a major axis h that extends horizontally left to right, and a minor axis v that extends vertically. This type of shape is known and used in dummies.

The guard is inclined at an angle to the shaft of the syringe adapter. If a reference axis h' is considered, extending horizontally, and perpendicular to the axis of the shaft 12 and syringe 30, the horizontal major axis h of the guard 20 is inclined from the reference axis h by an angle $\alpha$. It will be noted that while the guard shown in FIG. 2 lies generally in the plane of the page, the axis of the shaft is not oriented directly perpendicular to the plane of the page.

In use, medicine is drawn into the oral syringe in the conventional fashion by placing the dispensing end of the syringe beneath the surface of some medicine, and extending the syringe plunger 31. A bottle may include a neck insert to seal against the syringe, to allow the bottle be inverted, facilitating the filling process. The dispensing end of the filled syringe 30 is then inserted into the cavity 16 of the syringe adapter 10 via the opening 17 until the dispensing end of the syringe 30 abuts the annular end 13 of the syringe adapter 10. The shaft 12 may then be placed in the infant's mouth.

To ensure that the dispensing end of the filled syringe 30 is fully inserted into the cavity 16, the syringe adapter 30, or some part of the shaft 12 may be transparent.

Alternatively, the oral syringe 30 could be inserted into the syringe adapter 10 in an unfilled state, and the annular end of the syringe adapted inserted into the medicine bottle (either with or without the neck insert), before the syringe plunger 31 is pulled back to draw up medicine.

The upper concave curve 23 of the guard 20 locates under the infant's nose. Many users will have seen dummies of this shape, and even users who are not familiar with such a shape will instinctively know that the syringe adapted should be oriented in this way.

The user also naturally places the guard so that the plane of the guard coincides with the face of the infant. Since the plane of the guard is inclined with respect to the shaft of the syringe adapter and the syringe itself, the shaft of the syringe adapter is not directed directly towards the infant's throat, but is inclined sideways, extending towards the inside of the infant's cheek. When the user now dispenses the medicine by depressing the plunger, the medicine is directed towards the inside of the infant's cheek, in the recommended manner, and thereby alleviates the risk of choking the infant.

It will also be seen that the syringe adapter my equally be rotated 180° about the axis of the syringe adapter shaft 12. The guard is then oriented so that the concave curve 23 is now on the lower part of the guard and the concave curve 24 is on the upper part of the guard, but now the direction of the inclination of the shaft is reversed, so that when the user uses the syringe adapter with a syringe to dispense medicine, the medicine is directed to the infant's other cheek.

Since the user's natural inclination is to place the guard to lie generally flat against the infants mouth, with the infant's nose accommodated by one of the concave curves 23, 24, medicine will always be dispensed towards either cheek in the correct manner.

Other shapes of guard though may be used, provided that they lie against the baby's face in a way that inclines the syringe towards the baby's cheek. A round guard may do this although the user will have to ensure that the syringe is oriented in the correct direction. Novelty shaped guards (such as animals or cartoon characters, arrows) could also be used. Ideally, there will be some indication, whether by the shape and/or printed indicia on the guard or syringe adapter, to allow the user to correctly orient the syringe adapter. In the embodiment described above for example, this is achieved by the presence of a concave curve 23 or similar indentation on the guard 20 which locates under the infant's nose. Different peripheral shapes of the guard may be used to the same effect, such as a V-shaped indentation, or something that follows the shape of a nose more closely. Also, the guard may have a shaped surface or be shaped in some way other than planar, for example it may curve towards the edges, or be shaped to correspond to an infant's face when correctly oriented.

Many conventional oral syringes feature a short nozzle of hub 18 (U.S. Pat. No. 8,062,254 shows a conventional hub design for example). Where present, the hub 18 may either abut the inner surface of the annular end of the syringe 30, or may even be accommodated within the aperture 13, but ideally the thickness of material at the annular end of the syringe adapter should be chosen so that the hub does not extend beyond the syringe adapter. The edges of the syringe adapter are all rounded so that the syringe adapter is comfortable in the infant's mouth and cannot cause injury. The rounded nature of the syringe adapter shape, and the soft or resilient material, minimises the chance of damage or bruising of the infants' gums.

Figure 5:
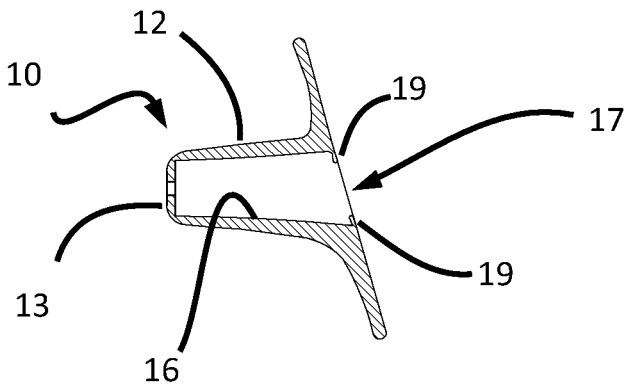
FIG. 5 is a longitudinal section of another embodiment of the syringe adapter and syringe.

Referring to FIG. 5, the cavity 16 of the syringe adapter may be gradually tapered, so that the radius of the cavity 16 at the annular end 15 is smaller than the radius of the cavity at the opening 17, which makes it easier to insert of the syringe into the syringe adapter. Around the opening is provided an annular flange 19 (for clarity, this is only the cross section is here shown, but it extends similarly around the entire circumference of the opening 17). When the syringe 30 is introduced into the cavity 16 via opening 17, the inner edge of flange 19 is sufficiently soft to bend into the cavity or otherwise deform(s) or give(s) way, allowing the syringe to enter the cavity. The resilience of the flange then grips and secures the syringe in the cavity, unless a sufficiently large force is used by the user to remove the syringe.

Figure 6:
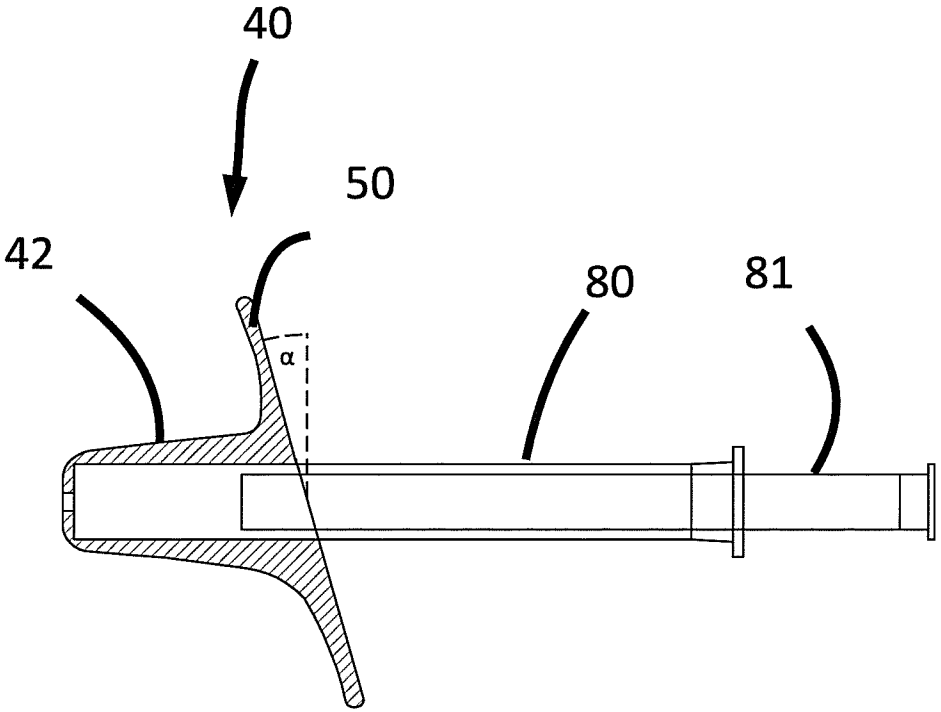
FIG. 6 is a longitudinal section of another embodiment of a syringe device.

Some of the same advantages may be provided by a syringe having an integral inclined guard. Referring to FIG. 6, a syringe 40 comprises a front shaft 42, guard 50, a rear syringe body 80 and plunger 81. The front shaft 42 and guard 50 have the same outer features as the syringe adapters described in the previous embodiments. The rear syringe body 80 and plunger are arranged as for a convention syringe. The syringe may either be formed by forming a front shaft and guard upon a conventional syringe and bonding the two components, or the front shaft, guard and rear syringe body could be formed from a single polymer piece into which a conventional plunger is then introduced. The adapter could also be used in conjunction with a dropper, which draws up liquid into a tube, and dispenses it, under the control of a flexible bulb.

Figure 7:
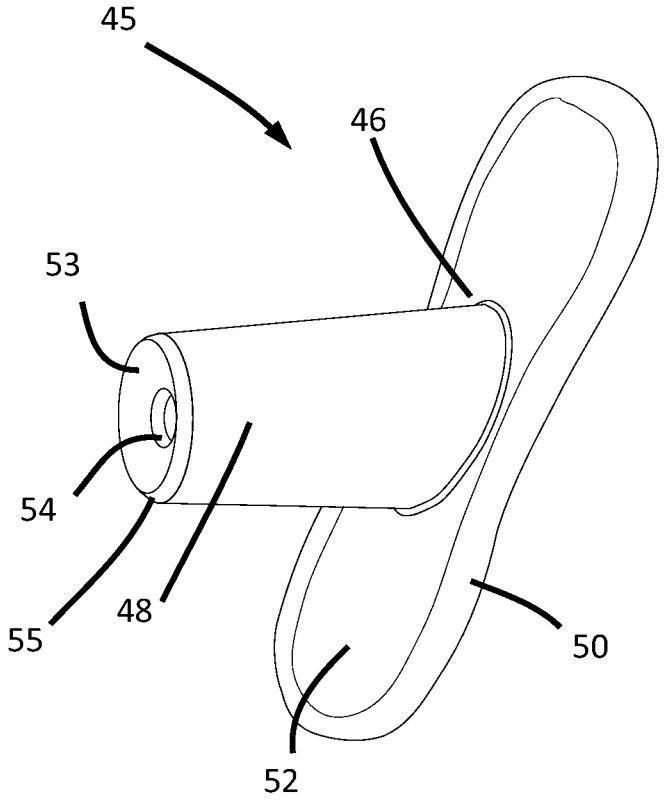
FIG. 7 is a perspective view of another embodiment of a syringe device.

The guard, or part of the guard, may be made of a material that is more rigid than silicone. If this is done, the rigid material could be coated or embedded in silicone or another softer material. Referring to FIG. 7, in another embodiment of the syringe adapter 45, the rim or outer peripheral area 50 of the guard 52 is made of hard plastic, which makes the adapter more robust. The rim 50 may either be disposed in the guard 52 beneath a silicone layer, or applied to the rim of the silicone or other material forming the remainder of the guard, or the guard may be given a hard finish on some or all of its edges to form the rim 50. The rim does not have to be continuous however. For example, the sides of the guard could be rigid, while the upper and lower edges (which may contact the infant's nose) are left more flexible.

In this embodiment, it will also be seen that the area 46 where the shaft 48 meets the guard 52, there is very little chamfer, compared to the embodiment shown in FIG. 1.

The shaft of the syringe adapter is designed to minimise the amount of medication that may be left in the adapter (and so not dispensed to the infant) when the syringe is operated. In particular, the end 53 of the shaft may have a conical surface, with the aperture 54 being set back from the shaft rim 55. In this manner, the thickness of material around the aperture 54 can be minimised, while the material of the end of the shaft 53 thickens towards the rim 55 to give the shaft end 53 reasonable strength. As the nozzle or hub of the syringe (or the flat end of the syringe if the syringe does not have a nozzle or hub) is pressed against the inner surface of the end of the shaft 53 when inserted into the syringe adapter, the thickness of the material of the syringe adapter around the aperture 54 contributes only a small additional volume above the syringe outlet for liquid to stay in after the syringe is operated. If the syringe does have a nozzle or hub, the shaft and aperture may even be arranged such that the end of the nozzle extends into or slightly protrudes from the aperture 53, further minimising or eliminating the loss or retention of medication due to the syringe adapter.

The front portion of the syringe (or syringe adapter) and the guard are ideally formed as a single moulded piece. However, they could be manufactured as two or more pieces and assembled.

Although the use of the device here is described with reference to infants, it will be realised that it could equally be used with adults and children. The device can be sized according to its intended use, with adult versions being somewhat larger than child or baby versions. The shaft will typically extend to up to 5 cm or 5.5 cm for a child, whereas for an adult it could extend up to 6 cm or 7 cm. The shaft will typically be at least 2 cm.

Although the embodiments shown here show a front shaft extending towards the side, so that the shaft lies in a generally horizontal plane, it will be realised that the shaft could also be set at an angle pointing slightly up or down in the mouth, that is, inclined to the horizontal or transverse planes. The front shaft may be angled so that dispensed liquid is directed towards the side of the cheek or the cheek pocket, or other similar areas of the side of the mouth, such as the upper or lower gums and teeth at the side of the mouth.

The guard may be made of flexible material, particularly if all or part of the guard's rim is rigid. The guard may be sufficiently flexible (or part of the shaft which connects to the guard), that the orientation of the front shaft can be varied when the guard is placed against a subject's face. In this way, someone using the syringe adapter on a subject (of the subject themselves, if they are self-administering) can change the orientation of the front shaft so that the liquid being dispensed is directed to the desired region at the side of the mouth.

The guard may not be flat, but may be profiled so that it rests against the user's face, so that the shaft is generally inclined to the frontal plane of the face, that is, a plane substantially parallel to the frontal or coronal plane of the skull.

The invention claimed is:

1. An oral dispensing device comprising a main body for holding liquid and a guard having a face bounded by edges, the main body being straight, elongated and having a longitudinal axis, and capable of dispensing the held liquid from one end, and the face of the guard being one of a generally planar face, or having a curve towards the edges, or be otherwise shaped to correspond to a face of a subject, and set upon the main body with the main body protruding from the face of the guard that is capable of contacting the face of the subject using the device, the main body and the guard being monolithic, the main body protruding directly from the guard, with no shaped surface where the guard meets the main body that would impede contact between the face of the subject and the face of the guard that is capable of contacting the face of the subject using the device the device is configured such that when the main body is placed in a mouth of the subject, the face of the guard that is capable of contacting the face of a subject using the device lies against the front of a face of the subject, such that if the front of the face of the subject is considered as a plane, the longitudinal axis of the main body is fixedly inclined to the plane of the face of the subject, and the device is further configured such that longitudinal axis may be directed sideways in the mouth.

2. The device according to claim 1 wherein the face of the guard describes a plane, and the longitudinal axis of the main body is fixedly inclined to the plane of the guard.

3. The device according to claim 1 wherein the face of the subject has a nose, and the guard is shaped such that at least one cut-away portion is provided to accommodate the nose of a face.

4. The device according to claim 1 wherein the face of the guard has reflective symmetry about horizontal and vertical axes.

5. The device according to claim 1 wherein the guard and the main body of the device are formed from a soft and flexible baby-safe material.

6. The device according to claim 1 wherein the guard and the main body of the device include a bore open at one end for the introduction of conventional syringe or dropper, wherein the bore includes an annular flange to grip and/or seal the conventional syringe or dropper with the guard and the main body, such that the longitudinal axis of the conventional oral syringe or a conventional dropper received in the main body is fixedly inclined to the plane of the face of the subject.

7. The device according to claim 1 wherein the guard assumes a position against the face of the subject such that the main body is directed towards the subject's cheek.

8. The device according to claim 1 wherein the main body of the device protrudes from the front of the wherein the planar face of the guard by less than 5.5 cm.

9. An apparatus, comprising:

a generally planar guard; and a main body protruding directly from the guard, with no shaped surface where the guard meets the main body that would impede contact between a face of a subject and the generally planar guard;

the main body being straight, elongated and having a longitudinal axis, and capable of dispensing a liquid from one end;

the guard and the main body of the device being formed as a single component, with the main body protruding from a face of the guard that is capable of contacting the face of the subject using the device, the guard and the main body being capable of receiving a conventional oral syringe or a conventional dropper;

the subject having a mouth, the the device is configured such that when the main body is placed in the mouth of a subject, the guard lies against the front of the face of the subject, such that if the front of the face of the subject is considered as a plane, the longitudinal axis of the main body and the longitudinal axis of the conventional oral syringe or the conventional dropper received in the main body are fixedly inclined to the plane of the face of the subject, and the device is further configured such that longitudinal axis may be directed sideways in the mouth.

10. The apparatus according to claim 9 wherein the guard and the main body are formed from a soft and flexible baby-safe material.

11. The apparatus according to claim 9 wherein the guard and the main body include a bore open at one end for the introduction of the conventional syringe or dropper, wherein the bore includes an annular flange to grip and/or seal the conventional syringe or dropper with the guard and the main body.

12. The apparatus according to claim 11 wherein a longitudinal axis of the bore is fixedly inclined to the plane of the guard.

13. The apparatus according to claim 9 wherein the face of the subject has a nose, and the guard is shaped such that at least one cut-away portion is provided to accommodate the nose of the face of the subject.

14. The apparatus according to claim 9 wherein the shape of the guard has reflective symmetry about horizontal and vertical axes.

15. The apparatus according to claim 9 wherein the guard assumes a position against the face of the subject such that the main body is directed towards the subject's cheek.

16. The apparatus according to claim 9 wherein the main body of device protrudes from the front of the wherein the planar face of the guard by less than 5.5 cm.

17. The apparatus according to claim 9 wherein the guard has a generally planar front.

* * * * *